US011019698B2

(12) United States Patent
Ackermann et al.

(10) Patent No.: US 11,019,698 B2
(45) Date of Patent: May 25, 2021

(54) RETROFIT LIGHT EMITTING DIODE, LED, LIGHTING DEVICE WITH REDUCED POWER CONSUMPTION IN STANDBY MODE

(71) Applicant: SIGNIFY HOLDING B.V., Eindhoven (NL)

(72) Inventors: Bernd Ackermann, Aachen (DE); Matthias Wendt, Wurselen (DE); Priya Ranjan Mishra, Bangalore (IN); Goutam Maji, Bangalore (IN)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 16/965,873

(22) PCT Filed: Feb. 5, 2019

(86) PCT No.: PCT/EP2019/052693
§ 371 (c)(1),
(2) Date: Jul. 29, 2020

(87) PCT Pub. No.: WO2019/149950
PCT Pub. Date: Aug. 8, 2019

(65) Prior Publication Data

US 2021/0037627 A1 Feb. 4, 2021

(30) Foreign Application Priority Data

Feb. 5, 2018 (IN) ..... 201841004221
Mar. 23, 2018 (EP) ..... 18163538

(51) Int. Cl.
*H05B 45/3725* (2020.01)
*H05B 47/19* (2020.01)
(Continued)

(52) U.S. Cl.
CPC ..... *H05B 45/3725* (2020.01); *F21K 9/278* (2016.08); *F21V 23/003* (2013.01); *H05B 47/19* (2020.01)

(58) Field of Classification Search
None
See application file for complete search history.

(56) References Cited

U.S. PATENT DOCUMENTS

2012/0161666 A1 6/2012 Antony et al.
2014/0055029 A1* 2/2014 Jans ..... F21K 9/27 315/74

(Continued)

FOREIGN PATENT DOCUMENTS

CN 204829650 U 12/2015
WO 2018007674 A1 1/2018

*Primary Examiner* — Anh Q Tran
(74) *Attorney, Agent, or Firm* — Daniel J. Piotrowski

(57) ABSTRACT

A retrofit Light Emitting Diode, LED, lighting device for connection to an electronic ballast, wherein said retrofit LED lighting device comprising an LED array for emitting light, an alternating current, AC, LED driver arranged for receiving an AC supply voltage or an AC supply current, from said electronic ballast and for driving said LED array based on said received AC supply voltage or said AC supply current, at least one switch, wherein in a closed position of said at least one switch, said retrofit LED lighting device provides a closed loop current circuit for an electronic ballast connected to said retrofit LED lighting device and in an open position of said at least one switch, said retrofit LED lighting device provides an open loop current circuit for an electronic ballast connected to said retrofit LED lighting device thereby simulating an absence of said LED lighting device to said electronic ballast, an auxiliary power supply and a stand-alone external trigger circuit, connected to said auxiliary power supply, and only dedicated for receiving an (Continued)

external trigger and for controlling said at least one switch based on said received external trigger.

15 Claims, 5 Drawing Sheets

(51) Int. Cl.
*F21V 23/00* (2015.01)
*F21K 9/278* (2016.01)

(56) References Cited

U.S. PATENT DOCUMENTS

| | | | | |
|---|---|---|---|---|
| 2015/0181161 | A1* | 6/2015 | Wang | H04N 7/147<br>348/14.08 |
| 2015/0198290 | A1 | 7/2015 | Segers et al. | |
| 2015/0223303 | A1 | 8/2015 | Hsia et al. | |
| 2016/0091147 | A1* | 3/2016 | Jiang | F21K 9/272<br>315/205 |
| 2016/0262220 | A1 | 9/2016 | Barnetson et al. | |
| 2017/0089521 | A1 | 3/2017 | Jiang | |
| 2017/0105265 | A1 | 4/2017 | Sadwick | |
| 2017/0105273 | A1 | 4/2017 | Tao | |

* cited by examiner

RETROFIT LIGHT EMITTING DIODE, LED, LIGHTING DEVICE WITH REDUCED POWER CONSUMPTION IN STANDBY MODE

CROSS-REFERENCE TO PRIOR APPLICATIONS

This application is the U.S. National Phase application under 35 U.S.C. § 371 of International Application No. PCT/EP2019/052693, filed on Feb. 5, 2019, which claims the benefit of India Patent Application No. 201841004221, filed on Feb. 5, 2018 and European Patent Application No. 18163538.4, filed on Mar. 23, 2018. These applications are hereby incorporated by reference herein.

FIELD OF THE INVENTION

The present invention generally relates to the field of lighting and, more specifically, to a retrofit Light Emitting Diode, LED, lighting device. The present invention further relates to a lighting system comprising an electronic ballast as well as a retrofit LED lighting device, and to a method of operating a retrofit LED lighting device.

BACKGROUND OF THE INVENTION

Lighting devices have been developed that make use of Light Emitting Diodes, LEDs, for a variety of lighting applications. Owing to their long lifetime and high energy efficiency, LED lamps are nowadays also designed for replacing traditional fluorescent lamps, i.e. for retrofit applications. For such an application, a retrofit LED lighting device is typically adapted to fit into the socket of the respective lamp fixture to be retrofitted. Moreover, since the maintenance of a lighting device is typically conducted by a user, the retrofit LED lighting device should ideally be readily operational with any type of suitable fixture without the need for re-wiring the fixture.

A specific type of a retrofit LED lighting device, i.e. a retrofit LED tube, is, for example, disclosed in US 2015/0198290. Here, an LED lighting device arrangement is disclosed for replacing a fluorescent lighting device in a luminaire having a ballast for supplying power to the lighting device. The LED lighting device arrangement comprises a plurality of LEDs arranged in a plurality of groups, wherein the groups of LEDs are connectable in a plurality of circuit configurations, including at least a first circuit configuration, and a second circuit configuration having a different circuit arrangement of the groups of LEDs in which at least a portion of the groups of LEDs are connected into the circuit differently than in the first circuit configuration.

Typically, ballasts are used in conventional fluorescent lamps to limit the current through the lamp, which could otherwise rise to destructive levels due to the negative differential resistance artefact in the tube's voltage-current characteristic.

One of the drawbacks in these known retrofit LED lighting devices is that, still too much unnecessary power is consumed. This is especially the case in a so-called standby mode. Typically, in a standby mode, electronics present in the retrofit LED lighting device are still powered by the ballast, but the LED array present in the lighting device does not emit any light. As such, the electronics ensure that the lighting device is, for example, receptive for receiving wireless commands, or anything alike, such that the lighting device can be switched back to a steady state mode. A steady state mode is a mode in which the retrofit LED lighting device is actually emitting light, i.e. the retrofit LED lighting device is turned on.

SUMMARY OF THE INVENTION

It would be advantageous to achieve a retrofit Light Emitting Diode, LED, lighting device that is designed in such a way that the total amount of power consumed in a standby mode is reduced. It would also be desirable to achieve a method of operating the retrofit LED lighting device such that the total amount of power in the standby mode is reduced.

To better address one or more of these concerns, in a first aspect of the invention, a retrofit Light Emitting Diode, LED, lighting device for connection to an electronic ballast is provided. The LED lighting device comprising:

an LED array for emitting light;

an alternating current, AC, LED driver arranged for receiving an AC supply voltage or AC supply current, from said electronic ballast and for driving said LED array based on said received AC supply voltage or said AC supply current;

at least one switch, wherein:

in a closed position of said at least one switch, said retrofit LED lighting device provides a closed loop current circuit for an electronic ballast connected to said retrofit LED lighting device;

in an open position of said at least one switch, said retrofit LED lighting device provides an opened loop current circuit for an electronic ballast connected to said retrofit LED lighting device thereby simulating an absence of said LED lighting device to said electronic ballast;

an auxiliary power supply;

a stand-alone external trigger circuit, connected to said auxiliary power supply, and only dedicated for receiving an external trigger and for controlling said at least one switch based on said received external trigger.

It was one of the insights of the inventors that the total amount of power during the standby mode is reduced in case the electronic ballast is switched off during that standby mode. Typically, the electronic ballast consumes about 2-8 Watt and the retrofit LED lighting device itself consumes a few hundreds of milliwatts. As such, it was found that it could be more beneficial to provide for means in the retrofit LED lighting device that ensure that the electronic ballast gets switched off, without switching the mains power supply. That is, the mains power supply is still operating effectively.

In order to accomplish that, at least one switch is provided, wherein in a closed position of said at least one switch, the retrofit LED lighting device provides for a closed loop current circuit for an electronic ballast connected to said retrofit LED lighting device and wherein, in an open position of said at least one switch, said retrofit LED lighting device provides for an opened loop current circuit for an electronic ballast connected to the retrofit LED lighting device thereby simulating an absence of said LED lighting device to said electronic ballast.

The electronic ballast will either switch itself off or go into a failure mode, in case the at least one switch is in an opened position. The electronic ballast will either sense that no current is drawn by the retrofit LED lighting device and/or will sense that no filament current is flowing and will use that information to determine that there is no retrofit LED lighting device present and will subsequently switch itself off.

It is noted that, in accordance with the present disclosure, at least one switch is provided for providing the closed loop current circuit for the electronic ballast and for providing the opened loop current circuit for the electronic ballast. Often, at least two switches are required for obtaining that particular purpose. That is, a retrofit LED lighting device typically comprises two filament circuits, and the at least two switches are then to be provided in these two filament circuits. A first switch in a first filament circuit and a second switch in a second filament circuit.

The present disclosure is directed to the situation in which the ballast is switched off or is in a failure mode. That is, the retrofit LED lighting device is in a standby mode. The inventors have found to introduce a stand-alone external trigger circuit, connected to the auxiliary power supply, and only dedicated for receiving an external trigger and for controlling the at least one switch based on the received external trigger.

The external trigger circuit is fed by the auxiliary power supply, at least in the standby mode, and is arranged to close the switch upon receipt of an external trigger. As such, the inventors have found that the external trigger circuit should drain as little power as possible. This increases the total amount of time that the retrofit LED lighting device is able to stay in a standby mode, i.e. in a mode in which it is not connected to an external power source.

This is accomplished by using a stand-alone circuit which is only dedicated for receiving an external trigger and is directly controlling the at least one switch.

The external trigger circuit is a standalone circuit. Its functionality is thus not implemented in a microcontroller which is also used for other purposes. The microcontroller would then also consume power for functionality which is strictly not needed in standby mode. This would result in more total power than a standalone implementation. The external trigger may be a sort of start-up or wake-up circuit. Once the at least one switch is closed again, sufficient power will be available again using the ballast and some of the functionality of the external trigger may even be taken over by other circuitry powered from the ballast, for example a microcontroller or the like.

The external trigger is only dedicated for controlling the at least one switch. Any additional functionality would increase the power needed which is not desired.

The external trigger circuit is directly controlling the at least one switch. As mentioned above for the standalone circuit, it is not preferred that the external trigger provides for an input to a microcontroller which is also used for other purposes. The functionality of the external trigger circuit is separated from the other functionalities of the retrofit LED lighting device, such that during the standby mode only the functionality of the external trigger circuit may be kept alive. In other words, the retrofit LED lighting device may be arranged to disable all its functionalities except for the external trigger circuit in the standby mode.

The at least one switch in accordance with the present disclosure may be provided in a filament circuit. A filament circuit may be provided for compatibility, safety, and/or reliability reasons. Such a filament circuit provides an interface between the electronic ballast and the retrofit LED lighting device by emulating the filament of a traditional fluorescent tube lamp.

The retrofit LED lighting device comprises an alternating current, AC, LED driver in order for the LED lighting device to be used as a replacement lighting device for a conventional fluorescent lighting device or a conventional fluorescent tube. The AC LED driver is arranged to receive an AC supply voltage or AC supply current at its input, to convert the AC supply voltage or AC supply current to a DC current, and to provide a DC current, at its output, to the LED array.

Different types of AC LED drivers exist, each of which are suitable to be used in the retrofit LED lighting device according to the present disclosure. For example, a half-wave rectification rectifier only allows the positive part of the AC supply voltage or AC supply current to pass while blocking the negative part of the AC supply voltage or AC supply current. This is typically accomplished using a single diode. In another example, a full wave rectification rectifier converts the whole of the AC supply voltage or AC supply current to one of constant polarity at its output. The positive part of the AC supply voltage or AC supply current is allowed to pass, and the negative part of the AC supply voltage or AC supply current is converted to a positive part. This may be accomplished using a bridge rectifier, or by using two diodes in combination with switches.

In accordance with the present disclosure, the lamp current is the current flowing from a first physical connection to the electronic ballast, via the LED lighting device, for example the electronics present in the LED lighting device, to the second physical connection to the electronic ballast. As such, the lamp current is not limited to the current flowing directly through the LED array.

In accordance with the present disclosure, the retrofit LED lighting device may be any of a retrofit LED tube or a retrofit LED photoluminescence lamp. A retrofit LED tube is a replacement LED tube for a fluorescent tube which is, for example, a low-pressure mercury-vapor gas-discharge lamp that uses fluorescence to produce visible light.

In accordance with the present disclosure, the external trigger may be a Radio Frequency, RF, beacon or an infrared light.

In an example, the retrofit LED lighting device comprises:

a harvesting circuit for harvesting energy for charging said auxiliary power supply.

The harvesting circuit may be any of:

solar cell-based energy harvesting;

Radio Frequency, RF, based energy harvesting;

inductance based energy harvesting;

mechanical vibration based energy harvesting.

The solar cell based energy harvesting may preferably be amorphous, i.e. placed on a top surface of the enclosure of the retrofit LED lighting device, or any type which may efficiently harvest diffused light. This may also extend the effective life of the auxiliary power supply, for example a battery. The auxiliary power supply may also be recharged by emitting light on any of the solar cells.

The RF based energy harvesting may be based on collecting energy from RF signals that are present in the vicinity of the retrofit LED lighting device, such as WiFi signals, Bluetooth signals, etc.

In another example, the stand-alone external trigger circuit is arranged for periodically listening for an external trigger during a predetermined ON-time.

The above entails that the external trigger circuit may stop operating and may start operating again after a period of time determined by, for example, a timer circuit. Such timer circuits can typically be built with minimal effort and may consume, as being mostly digital, only marginal power. This further reduces standby power while extending the period of time in which the retrofit LED lighting device can be kept in standby mode.

In a further example, the at least one switch comprises a normally open switch.

Using normally open switches in the filament emulation circuit reduces the standby power consumption since these switches need not be powered to keep the ballast switched off, i.e. to keep providing an open loop current circuit for the electronic ballast.

During normal operation of the retrofit LED lighting device, when it is connected to the electronic ballast and obtains power from the electronic ballast, normally open switches must be actively closed. The retrofit LED lighting device is switched to the standby power mode when, in addition to keeping an energy reserve that is sufficient for powering the retrofit LED lighting device while it triggers transition from standby mode to steady state mode, mainly operate the at least one switch in order to restart the ballast, there is still sufficient energy stored in the auxiliary power supply to stay in this standby mode for a sufficiently long period of time.

As such, by using normally open switches, the amount of power dissipated in the standby mode is reduced even further.

In another example, the stand-alone external trigger circuit comprises a photodiode for receiving an external trigger in the form of infrared light.

In a second aspect, there is provided a lighting system, comprising:

an electronic ballast, and a retrofit LED lighting device according to any of the examples as provided above, wherein said retrofit LED lighting device is connected to said electronic ballast.

Electronic ballasts may regulate the electric flow inside the lamp through electronic circuitry. The electronic ballast, sometimes also referred to as control gear, is typically arranged to limit the current which flows in an electric circuit such that the current is basically kept at a level that prevents the lamp from burning out.

It is noted that the advantages and definitions as disclosed with respect to the embodiments of the first aspect of the invention, being the retrofit LED lighting device, also correspond to the embodiments of the second aspect of the invention, being the lighting system, respectively.

In an embodiment, the electronic ballast is arranged for measuring a current flowing from said electronic ballast to said connected retrofit LED lighting device, and for switching itself off in case no current is measured.

In a third aspect, there is provided a method of operating a retrofit LED lighting device according to any of the examples as provided above, wherein said method comprises the steps of:

opening, by said retrofit LED lighting device, said at least one switch thereby simulating absence of said retrofit LED lighting device to said electronic ballast;

receiving, by said stand-alone external trigger circuit, said external trigger;

closing, by said stand-alone external trigger circuit, said at least one switch based on said received external trigger. This cancels the simulating of the absence of the retrofit LED lighting device to the electronic ballast such that the electronic ballast may start to provide power again to the retrofit LED lighting device.

It is noted that the advantages and definitions as disclosed with respect to the embodiments of the first aspect and the second aspect of the invention, being the retrofit LED lighting device and the lighting system, also correspond to the embodiments of the third aspect of the invention, being the method, respectively.

In an example, said method further comprises the step of:

disabling, by said retrofit LED lighting device, all functionalities of said retrofit LED lighting device, triggered by said opening of said at least one switch, except for functionality provided by said stand-alone external trigger circuit.

In a further example, the retrofit LED lighting device comprises a harvesting circuit and wherein said method comprises the step of:

harvesting, by said harvesting circuit, energy for charging said auxiliary power supply.

In an example, the harvesting circuit is any of:

solar cell based energy harvesting;

Radio Frequency, RF, based energy harvesting;

inductance based energy harvesting;

mechanical vibration based energy harvesting.

The method may further comprise the step of:

periodically listening, by said stand-alone external trigger circuit, for an external trigger during a predetermined ON-time.

The at least one switch may comprise a normally open switch.

In another example, the stand-alone external trigger circuit comprises a photodiode for receiving an external trigger in the form of infrared light.

In yet another aspect, there is provided a computer program product containing computer program code which, when executed by a retrofit LED lighting device, cause the retrofit LED lighting device to implement the method according to any of the examples as provided above.

These and other aspects of the invention will be apparent from and elucidated with reference to the embodiment(s) described hereinafter.

DETAILED DESCRIPTION

A detailed description of the drawings and figures are presented. It is noted that a same reference number in different figures indicates a similar component or a same function of various components.

Figure 1:
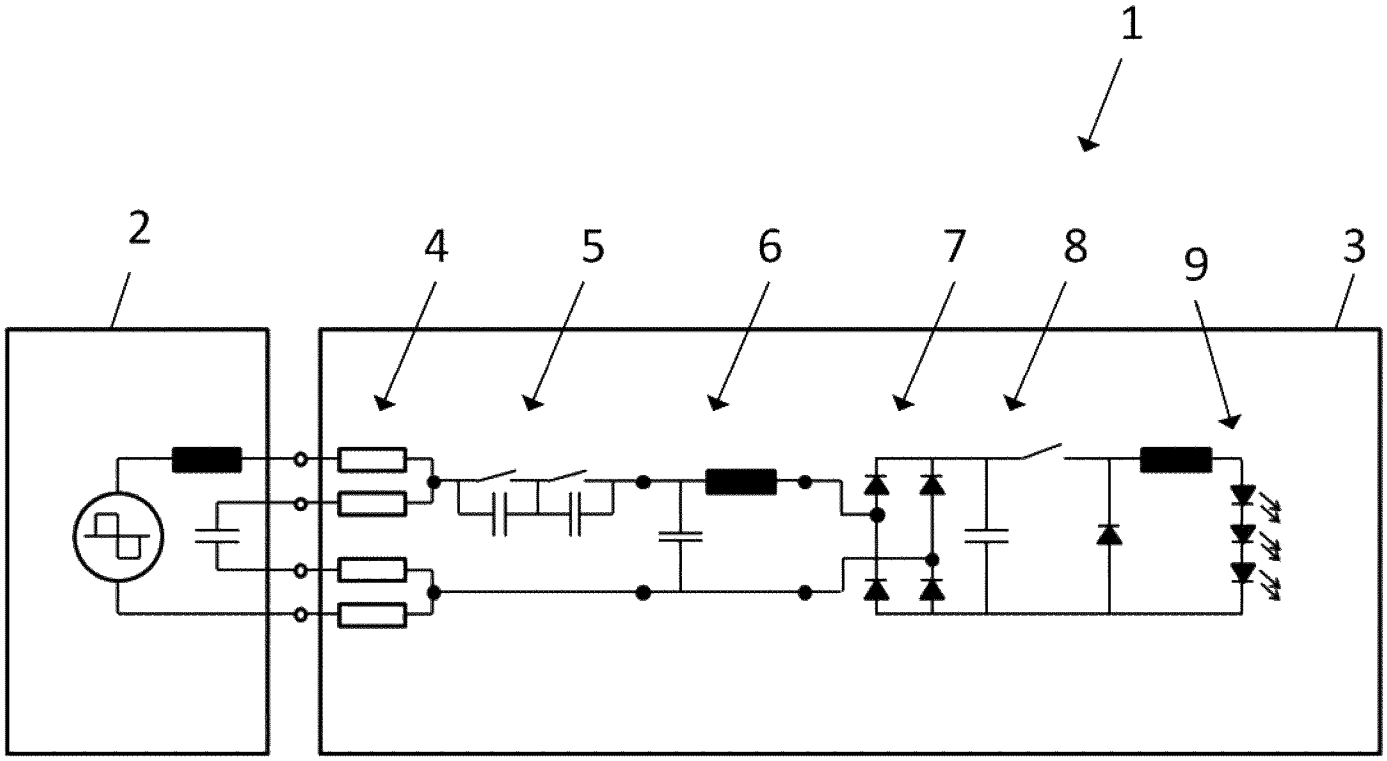
FIG. 1 shows a schematic block diagram representation of a lighting system as available in the prior art.

FIG. 1 shows a schematic block diagram 1 representation of a lighting system as available in the prior art. The lighting system comprises an electronic ballast 2 as well as a retrofit Light Emitting Diode, LED, lighting device 3. The LED lighting device 3 is arranged to receive power from the electronic ballast 2, which in turn is connected to an AC mains power supply. The AC mains power supply can be any power supply available normally to a domestic consumer of electric power at the wall socket or at a suitable power outlet. The electronic ballast 2 is normally designed to be operated with a fluorescent tube and is arranged to provide an output specific to the type of the fluorescent tube that is connected thereto. The ballast can be an IC controlled ballast, or a self-oscillating ballast, high frequency ballast, or any other type of ballast.

Conventionally, and most popularly, electronic ballasts are designed for use with fluorescent tubes. However, it is desired to replace these fluorescent lamps with more energy efficient LED lighting devices. This requires the electronic ballasts to be replaced and additional wiring to be made. This is often undesirable because, often, it is the consumer itself who is responsible for the installation and maintenance of such LED lighting devices. Therefore, it would be advantageous to avoid rewiring and installation of extra components. Incorporating additional circuitry into the LED tube itself provides a method of using the same electronic ballast for LED lighting devices. This process, called retrofitting, is popular and leads to considerable savings in installation and operational costs.

Typically, the retrofit LED lighting device 3 comprises a plurality of components which are elucidated in some more detail here below. A filament emulation circuit 4 is often present to emulate the presence of a filament of a fluorescent tube. A pin safety and start-up circuit 5 is present to provide additional safety elements that ensure safe operation of the retrofit LED lighting device 3. When the at least one switch in the start-up circuit 5 is open, then it provides the huge impedance in the order of several Megaohm that is characteristic for a fluorescent tube before it has been ignited. A matching circuit 6 is present to match the output impedances to each other. An alternating current, AC, LED driver 7, 8 is present which is arranged for receiving an AC supply voltage or AC supply current, from said electronic ballast and for driving an LED array based on the received AC supply voltage or AC supply current. Finally, the LED array 9 is present in the retrofit LED lighting device 3.

One of the challenges in the field of retrofit LED lighting devices is to reduce the amount of power consumed of the lighting system in a standby mode. The present disclosure is directed to that particular concept. This is elucidated in more detail with reference to FIGS. 2-5.

Figure 2:
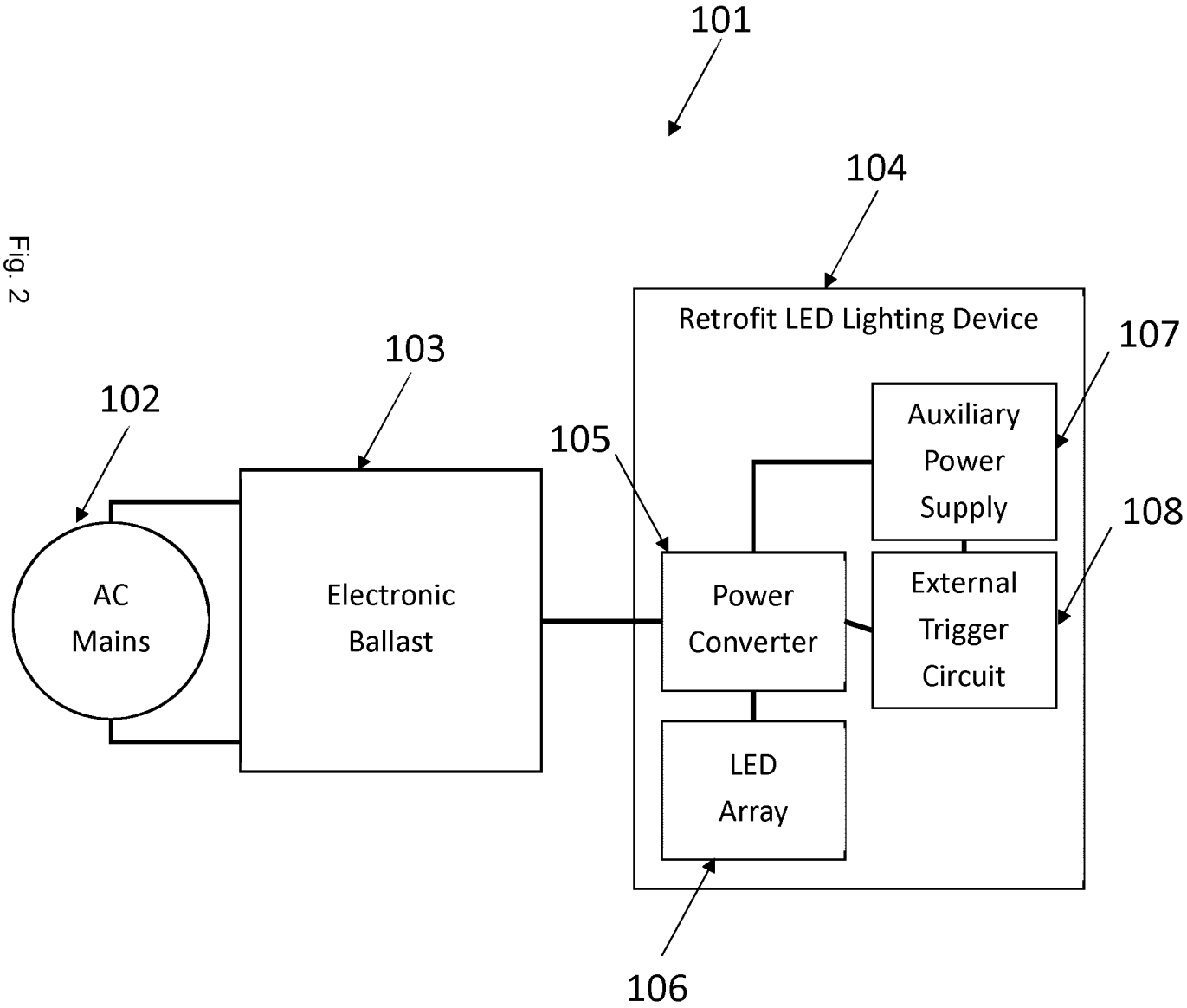
FIG. 2 shows an exemplary embodiment of a lighting system in accordance with the present disclosure.

FIG. 2 shows an exemplary embodiment of a lighting system 101 in accordance with the present disclosure.

The lighting system 101 comprises an electronic ballast 103 and a retrofit LED lighting device 104. The electronic ballast 103 is connected to an AC mains power supply 102.

Not all the components of the retrofit LED lighting device 104 are shown for simplicity reasons. As such, a power converter 105 is present as well as an LED array 106 for emitting light. The power converter 105 may thus comprise the filament emulation circuit, pin safety and start-up circuit, matching circuit, and the alternating current, AC, LED driver for receiving an AC supply voltage or AC supply current, from the electronic ballast and for driving the LED array based on the received AC supply voltage or AC supply current.

The retrofit LED lighting device 104 comprises an auxiliary power supply 107 and a stand-alone external trigger circuit 108. Further, at least one switch is provided in the retrofit LED lighting device 104 inside the power converter 105 which is elucidated in more detail with reference to FIG. 4.

The at least one switch is arranged to, in a closed position, provide for a closed loop current circuit for the electronic ballast 103 connected thereto. In an open position, said at least one switch is arranged to provide for an opened loop current circuit for the electronic ballast 103 connected thereto such that the LED lighting device emulates, i.e. simulates, an absence of the LED lighting device to the electronic ballast. This causes the electronic ballast to shut down such that it reduces the total amount of power drawn by the lighting system.

The auxiliary power supply 107 is, for example, a large capacitor, a battery or anything alike. The capacitor gets charged during a steady state mode. This means that the electronic ballast is providing power to the LED array for emitting light but is also providing a charge current to the capacitor. The auxiliary power supply 107 can also comprise circuitry for controlling the charging and the supply of power to the auxiliary power supply 107.

Once the standby mode is activated, the power drawn from the electronic ballast is cut off. The electronics will then be powered by the auxiliary power supply, for example a battery, itself. This means that the battery will slowly get discharged. As mentioned above, the electronics present in the retrofit LED lighting device draw, typically, a few hundreds of milliwatts. As such, the size of the battery should be chosen in such a way that the capacitor is able to provide power to the electronics for at least a predefined amount of time, for example a few minutes, a few hours, a full day, etc.

A stand-alone external trigger circuit 108 is provided in order to increase the amount of time that the LED lighting device 104 is able to stay in standby mode. The purpose of introducing such an external trigger circuit 108 is that all functionality of the LED lighting device 104 may be switched of during the standby mode except for the functionality of the external trigger circuit. This allows the external trigger circuit 108 to be designed in such a way that it only consumes power for the purpose it is designed for.

That is, the external trigger circuit 108 is only dedicated for controlling the switches. Any additional functionality would increase the power needed which is not desired.

The external trigger circuit is directly controlling the at least one switch. As mentioned above for the standalone circuit, it is not preferred that the external trigger provides for an input to a microcontroller which is also used for other purposes. The functionality of the external trigger circuit is separated from the other functionalities of the retrofit LED lighting device, such that during the standby mode only the functionality of the external trigger circuit may be kept alive. In other words, the retrofit LED lighting device may be arranged to disable all its functionalities except for the external trigger circuit in the standby mode.

The retrofit LED lighting device 104 comprises, for example, two connection terminals for connecting to said electronic ballast, wherein each terminal comprises two connecting pins, wherein said at least one switch is comprised by the two filament circuits, wherein each connecting terminal is coupled to one of said two filament circuits for connecting the corresponding two connecting pins thereof to each other.

Figure 3:
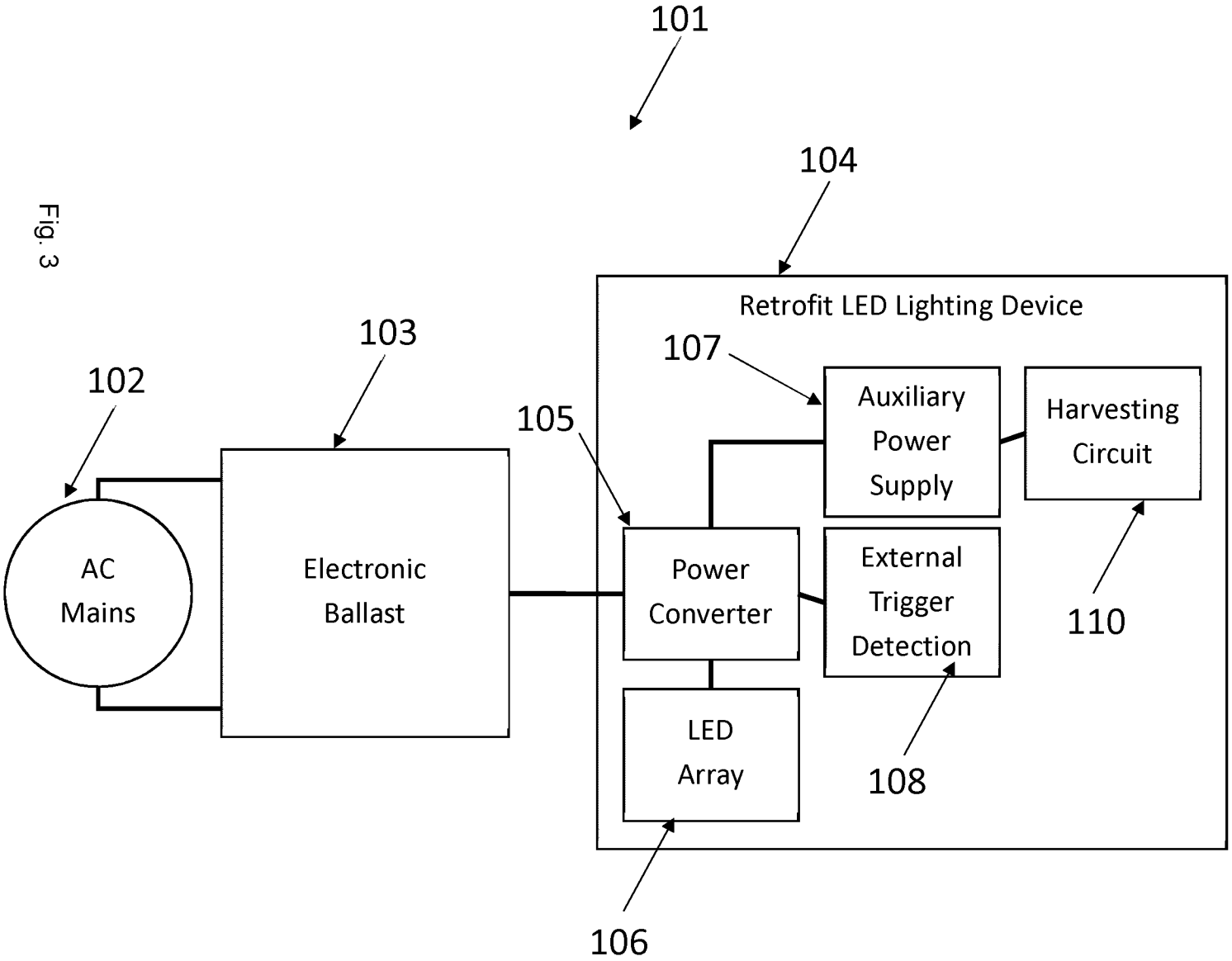
FIG. 3 shows a second embodiment of a lighting system in accordance with the present disclosure.

FIG. 3 shows a second embodiment of a lighting system 101 in accordance with the present disclosure.

Aspects having the same, or similar, functionality have been referenced with the same reference numeral for increasing the readability. The main difference with the embodiment shown in FIG. 3 compared to the embodiment shown in FIG. 2 is that a harvesting circuit 110 is provided for harvesting energy for charging said auxiliary power supply 107, for examples a battery.

The harvesting circuit 110 may be any of:

solar cell based energy harvesting;

Radio Frequency, RF, based energy harvesting;

inductance based energy harvesting;

mechanical vibration based energy harvesting.

Figure 4:
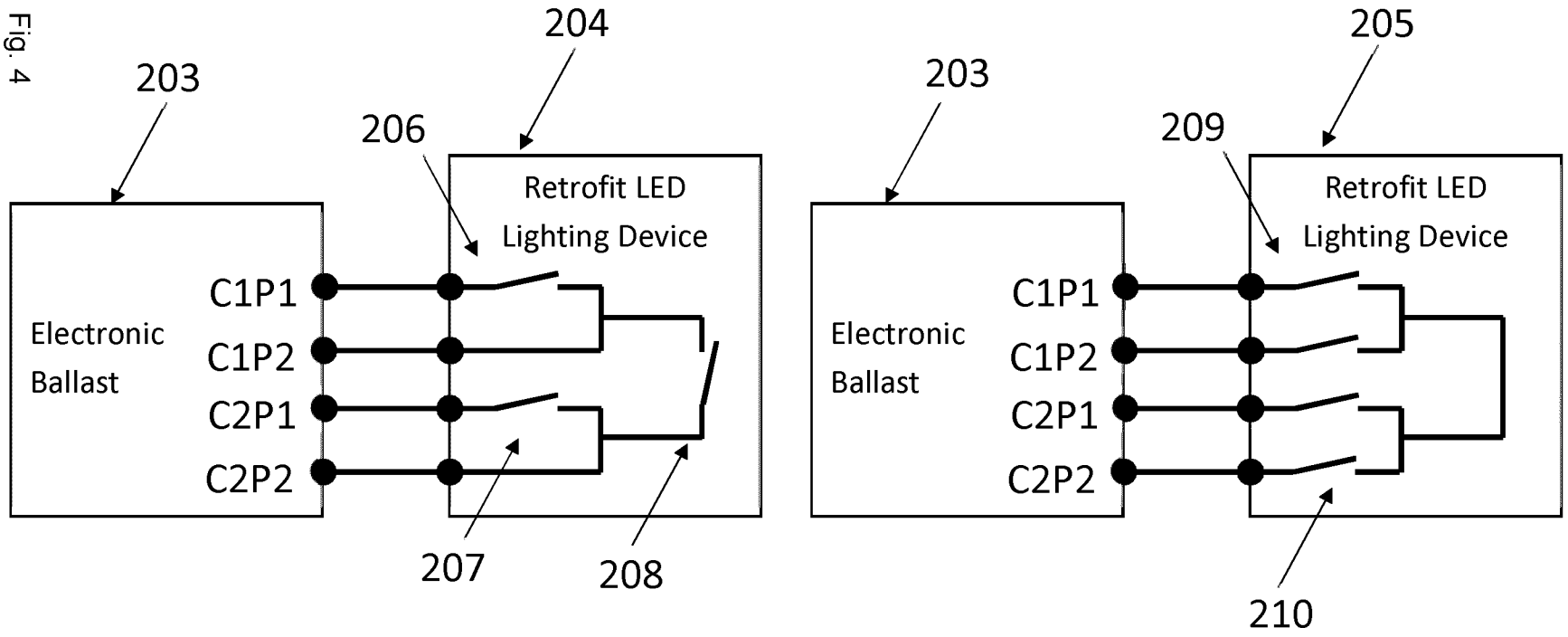
FIG. 4 shows an example of a retrofit LED lighting device in which the at least one switch is highlighted.

FIG. 4 shows an example of a retrofit LED lighting device in which the at least one switch is explained in more detail.

The retrofit LED lighting device 204 may be connected to the electronic ballast 203 via an end cap on one end and an end cap on the other end. Each end cap may have two pins: pin P1 and in P2. The above is referenced to using reference numerals C1P1, C1P2, C2P1 and C2P2.

In the retrofit LED lighting device shown in FIG. 4, the filament circuitry gives the electronic ballast 203 the impression that there is a filament present with an appropriate resistance value. That is, the electronic ballast 203 assumes that a conventional fluorescent tube lamp is connected to the electronic ballast 203. Otherwise, many ballasts would conclude that there is something wrong and stop working. The switches 206, 207 in the retrofit LED lighting device 204 may be closed when the electronic ballast expects the filaments to be present. The switch 208 in the retrofit LED lighting device 204 may be closed when the electronic ballast expects ignition of the gas. This reduces the resistance seen by the electronic ballast 203.

When the switches 206, 207, 208 are opened, then the ballast concludes that the lamp has broken or that it has been removed. The ballast should start working again when a broken lamp has been replaced or when the lighting device has been inserted again. Lamp failure is often due to broken filaments. So, in practice, presence of both filaments can be interpreted as a new lamp being inserted. Many ballasts will check this and try to start operating again, i.e. preheat, ignite, etc., when the filaments are present. This feature is used by the switches 206, 207 in the filament circuit.

The switches 206, 207 can be parallel to relatively large resistances of about 10 . . . 20 Ohm. When a switch 206, 207 is open, the electronic ballast will determine a large filament resistance, interpret this as a problem and not start with preheat, ignition, etc. In this state the ballast only consumes little power from the mains. When the switches 206, 207 close, filament resistance seen by the ballast will go down and the ballast will start normal operation, i.e. preheat, ignite, etc.

One filament switch would be sufficient for ballasts monitoring both filaments. There are however also ballasts monitoring only one filament, and for controlling these independent of the direction in which the TLED is inserted, two switches may be needed, i.e. one in each of the two filament circuits.

The purpose of the switch 208 in series with driver & LEDs is different from the purpose of the switches 206, 207 in the filament circuits. The switch 208 in series with driver & LED has to cope with the ballast trying to ignite the lamp and it has to provide safety isolation between the two ends of the retrofit LED lighting device when it is open. Therefore, it will be bigger, more costly, etc. than the filament switches 206, 207. In principle it is possible to replace this switch by a switch that disconnects C1P2 from the retrofit LED lighting device. But then two switches, connected to C1P1 and C1P2, must cope with ignition and safety isolation. This increases the implementation effort and will not be done in practice. Alternatively, two switches 210, connected to C2P1 and C2P2 can cope with ignition and safety isolation.

Figure 5:
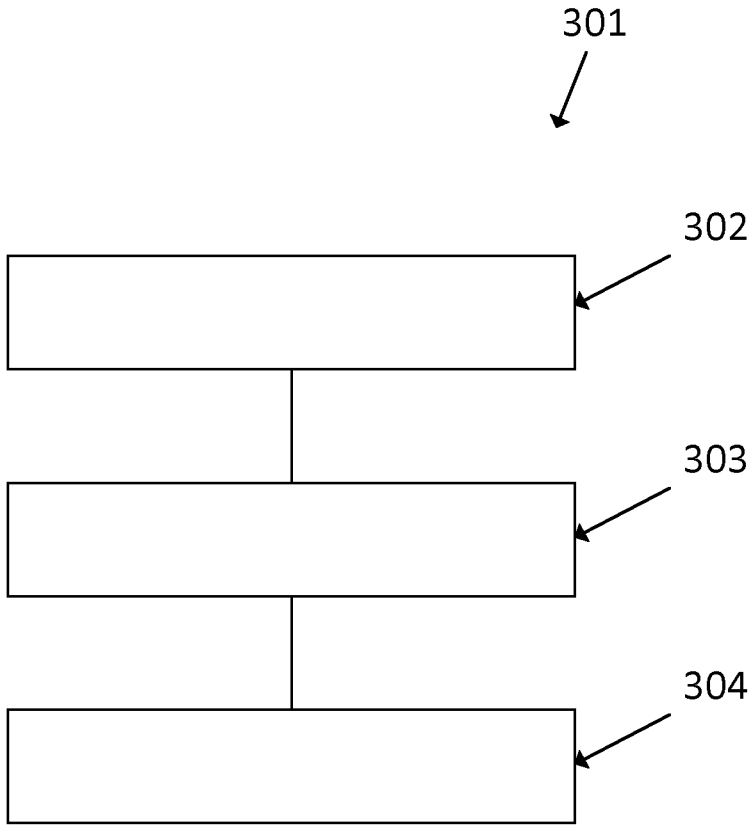
FIG. 5 shows an example of a flowchart illustrating a method in accordance with the present disclosure.

FIG. 5 shows an example of a flowchart illustrating a method in accordance with the present disclosure.

The flowchart 301 is directed to a method of operating a retrofit LED lighting device according to any of the examples as provided above, wherein said method comprises the steps of:

opening 302, by said retrofit LED lighting device, said at least one switch thereby simulating absence of said retrofit LED lighting device to said electronic ballast;

receiving 303, by said stand-alone external trigger circuit, said external trigger;

closing 304, by said stand-alone external trigger circuit, said at least one switch based on said received external trigger. This cancels the simulating of the absence of the retrofit LED lighting device to the electronic ballast such that the electronic ballast may start to provide power again to the retrofit LED lighting device.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A retrofit Light Emitting Diode, LED, lighting device for connection to an electronic ballast, wherein said retrofit LED lighting device comprising:

an LED array for emitting light;

an alternating current, AC, LED driver arranged for receiving an AC supply voltage or an AC supply current, from said electronic ballast and for driving said LED array based on said received AC supply voltage or said AC supply current;

at least one switch, wherein:

in a closed position of said at least one switch, said retrofit LED lighting device provides a closed loop current circuit for an electronic ballast connected to said retrofit LED lighting device;

in an open position of said at least one switch, said retrofit LED lighting device provides an open loop current circuit for an electronic ballast connected to said retrofit LED lighting device thereby simulating an absence of said LED lighting device to said electronic ballast;

an auxiliary power supply for powering a stand-alone external trigger circuit;

the stand-alone external trigger circuit, connected to said auxiliary power supply, and only dedicated for receiving an external trigger and for controlling said at least one switch based on said received external trigger.

2. A retrofit LED lighting device in accordance with claim 1, wherein said retrofit LED lighting device comprises:

a harvesting circuit for harvesting energy for charging said auxiliary power supply.

3. A retrofit LED lighting device in accordance with claim 2, wherein said harvesting circuit is any of:

solar cell based energy harvesting;

Radio Frequency, RF, based energy harvesting;

inductance based energy harvesting;

mechanical vibration based energy harvesting.

4. A retrofit LED lighting device in accordance with claim 1, wherein said stand-alone external trigger circuit is arranged for periodically listening for an external trigger during a predetermined ON-time.

5. A retrofit LED lighting device in accordance with claim 1, wherein said at least one switch comprises a normally open switch.

6. A retrofit LED lighting device in accordance with claim 1, wherein said stand-alone external trigger circuit comprises a photodiode for receiving an external trigger in the form of infrared light.

7. A lighting system, comprising:

an electronic ballast, and a retrofit LED lighting device according to claim 1, wherein said retrofit LED lighting device is connected to said electronic ballast.

8. A method of operating a retrofit LED lighting device according to claim 1, wherein said method comprises the steps of:

opening, by said retrofit LED lighting device, said at least one switch thereby simulating absence of said retrofit LED lighting device to said electronic ballast;

receiving, by said stand-alone external trigger circuit, said external trigger;

closing, by said stand-alone external trigger circuit, said at least one switch based on said received external trigger.

9. A method in accordance with claim 8, wherein said method further comprises the step of:

disabling, by said retrofit LED lighting device, all functionalities of said retrofit LED lighting device, triggered by said opening of said at least one switch, except for functionality provided by said stand-alone external trigger circuit.

10. A method in accordance with claim 8, wherein said retrofit LED lighting device comprises a harvesting circuit and wherein said method comprises the step of:

harvesting, by said harvesting circuit, energy for charging said auxiliary power supply.

11. A method in accordance with claim 10, wherein harvesting circuit is any of:

solar cell based energy harvesting;

Radio Frequency, RF, based energy harvesting;

inductance based energy harvesting;

mechanical vibration based energy harvesting.

12. A method in accordance with claim 8, wherein said method further comprises the step of:

periodically listening, by said stand-alone external trigger circuit, for an external trigger during a predetermined ON-time.

13. A method in accordance with claim 8, wherein said at least one switch comprises a normally open switch.

14. A method in accordance with claim 8, wherein said stand-alone external trigger circuit comprises a photodiode for receiving an external trigger in the form of infrared light.

15. Computer program product containing computer program code which, when executed by a retrofit LED lighting device, causes the retrofit LED lighting device to implement the method according to claim 1.

* * * * *